United States Patent [19]

Larsen

[11] Patent Number: 4,635,309

[45] Date of Patent: Jan. 13, 1987

[54] MULTIPLE USE HAND TOOL

[76] Inventor: Peter L. Larsen, 2186 Montgomery Ave., Apt. 6, Cardiff By The Sea, Calif. 92007

[21] Appl. No.: 735,090

[22] Filed: May 17, 1985

[51] Int. Cl.[4] ..... B25F 1/04

[52] U.S. Cl. ..... 7/158; 30/162

[58] Field of Search ..... 7/158, 160; 30/151, 30/162

[56] References Cited

U.S. PATENT DOCUMENTS

| | | | |
|---|---|---|---|
| 220,632 | 10/1879 | McGill | 30/162 |
| 273,232 | 2/1883 | Hoffman | 30/162 |
| 1,853,672 | 4/1932 | Dodson | 30/162 |
| 2,198,111 | 4/1940 | Gorbatenko et al. | 30/162 |
| 3,107,426 | 10/1963 | Robinson, Jr. | 30/162 |
| 3,660,896 | 5/1972 | Umholtz | 30/162 |
| 4,005,525 | 2/1977 | Gringer | 30/162 |
| 4,196,515 | 4/1980 | Sugiyama | 30/162 |

*Primary Examiner*—Roscoe V. Parker

*Attorney, Agent, or Firm*—Baker, Maxham & Jester

[57] ABSTRACT

A multiple use hand tool comprises an elongated housing defining a handle having a longitudinal through bore in which is slideably mounted a tool holding member for holding a utility knife blade at one end and a marking crayon at the other end for selective extension from the respective end of the handle for use. The tool holding member is releasable for sliding from the housing for removal and replacement of a tool.

20 Claims, 8 Drawing Figures

MULTIPLE USE HAND TOOL

BACKGROUND OF THE INVENTION

The present invention relates to tools and pertains particularly to mulitple tools mounted in a common holder.

Many workmen, such as carpenters, machinists, etc., require various tools for carrying out their tasks. A number of these tools have blades or points that wear with use and require frequent change. It is therefore desirable that the blades or the like be easily replaceable.

The tools for these workmen must be ready at hand in order to enable them to function most efficiently. For this reason carpenters and the like typically carry special belts or aprons having numerous pockets. These however, still limit the number of tools that can be carried by an individual. It would frequently be advantageous for two or more tools to be integrated into one body or holder when possible.

Tools must be affordable in order to be readily available to the average workmen. In order for a tool to be affordable, it should be simple, easy to manufacture and have easily replaceable parts. The tool must also be rugged and have a long life in order to be practical.

Accordingly, it is desirable that simple, inexpensive, yet rugged multiple use tools be available.

SUMMARY AND OBJECTS OF THE INVENTION

It is the primary object of the present invention to provide an improved multiple use tool.

In accordance with a primary aspect of the present invention, this multiple use tool comprises a common elongated handle having an internal slide member having means on opposite ends thereof for holding different tools for selective extension from a selected end of the handle.

BRIEF DESCRIPTION OF THE DRAWING

The above and other objects of the present invention will become apparent from the following description when read in conjunction with the accompanying drawing wherein.

DETAILED DESCRIPTION OF A PREFERRED EMBODIMENT

Figure 1:
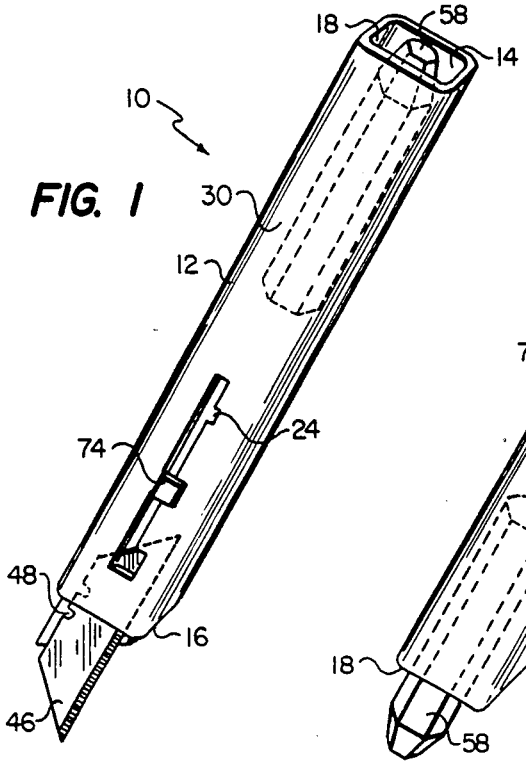
FIG. 1 is a perspective view of the tool with a cutting blade in position for use.

Referring to FIG. 1 of the drawing, a tool in accordance with the present invention designated generally by the numeral 10 is illustrated. The multiple use tool or, as it also may be stated, the multiple tool holder, in accordance with the invention comprises generally an elongated tubular housing 12 which defines a handle having a generally rectangular cross section and a similarly configured, preferably uniform cross section through bore extending along the entire axis thereof. The outer configuration of the housing may be shaped as desired to fit the hand for a more comfortable hand feel to improve the grasping thereof for hand manipulation. On the other hand, the preferred form is as illustrated, having a substantially uniform cross section with rounded corners which provides a reasonable handle feel, but in conjunction with the uniform through bore provides a housing or handle member that can be easily produced by extrusion.

Figure 2:
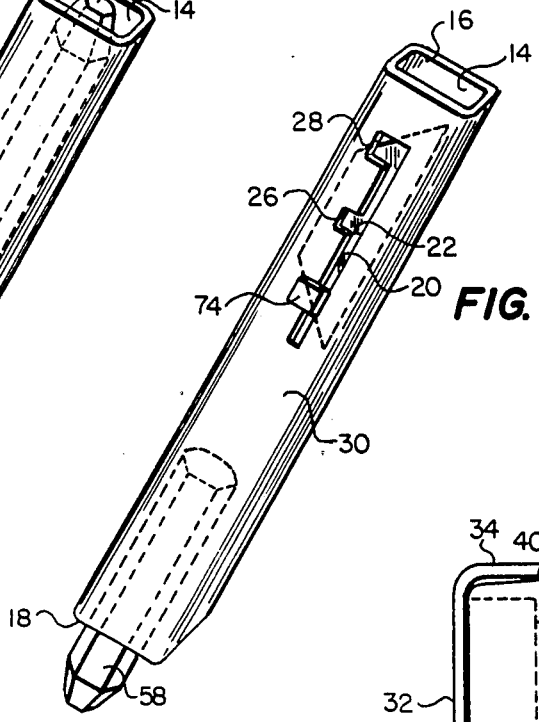
FIG. 2 is a view like FIG. 1 showing a marker in position for use.
Figure 3:
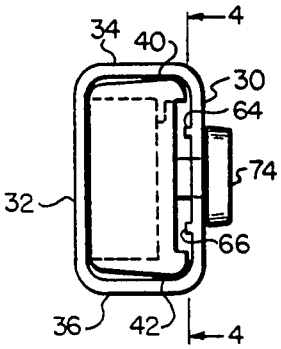
FIG. 3 is an end view of the embodiment of FIG. 1.

The handle can be made of any suitable extrudable material that forms a hard durable handle, such as a hard plastic, aluminum or other suitable materials. As can be seen in FIG. 1–3, the housing is formed as a rectangular tubular member having a through bore 14 defining open ends 16 and 18 from which tools will project as will be explained.

The housing includes an elongated slot 20 formed through one side wall thereof with the slot having one edge 22 preferably being straight with a parallel opposite side edge having a plurality of notches 24, 26 and 28. The notches 24 and 26 form detents or stop means with the notch 28 forming a stop and a releasing port as will be explained. The slot 20 extends along the longitudinal axis or parallel to the longitudinal axis of the housing or handle terminating in ends **20*a* and 20*b*** that also define stops.

Disposed within the bore of the housing for reciprocable movement therein is a slide member designated generally by the numeral 38 (FIGS. 4 and 6) and mounted for slideable movement along the longitudinal axis of the housing as will be described. For convenience of understanding, the housing 12 will be designated as having a top face or wall 30, a back face or wall 32, which is opposite the front face and opposite or opposed side faces or walls 34 and 36.

The slide member 38 is defined by a pair of spaced apart, parallel extending curved side walls or runners 40 and 42 which are formed as shown in FIG. 3 to engage a small surface of the side walls 34 and 36 of the housing 12 adjacent the front face 30 thereof. This reduces the contact area of the slide with the interior of the housing wall and thereby reduces possible binding of the slide within the housing. These guides or runners 40 and 42 are connected together by a web portion 44 extending therebetween and spaced from the front face 30, thereby forming a recess for receiving a utility knife blade 46 as shown in FIG. 1.

Figure 4:
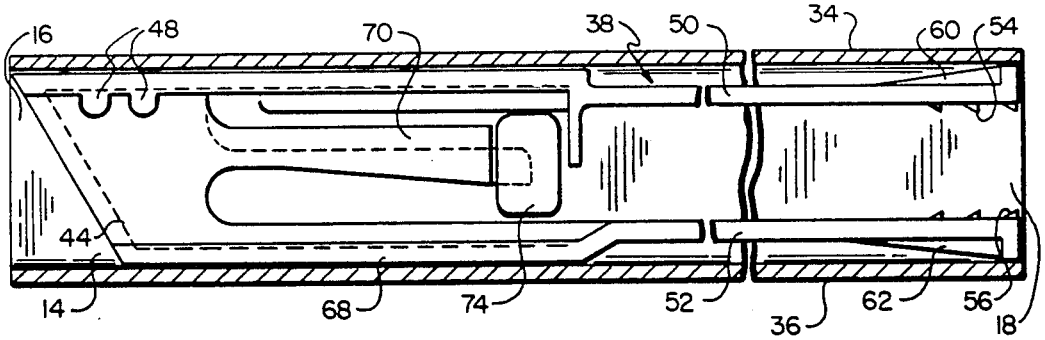
FIG. 4 is a section view taken generally on line 4—4 of FIG. 3.
Figure 5:
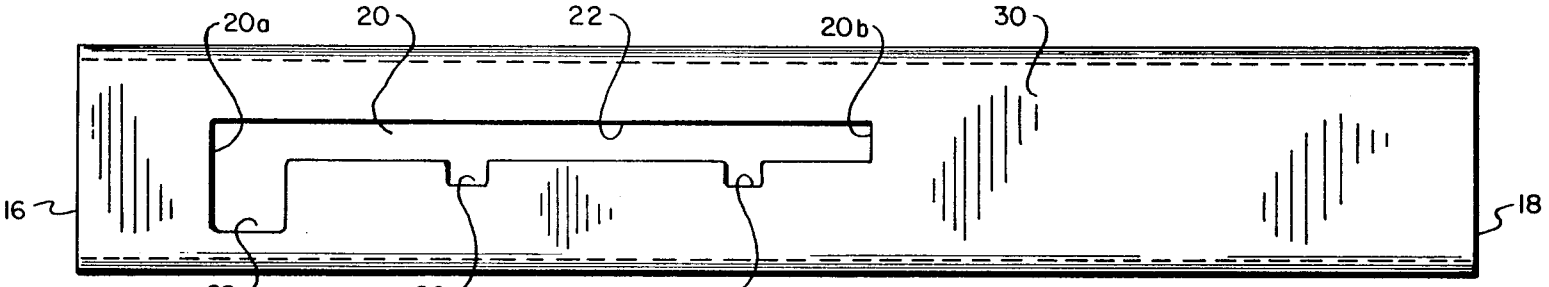
FIG. 5 is a side view of the embodiment of FIG. 1 with the slide removed.

A pair of tabs or ribs 48 extend into the recess area formed by the main body portion of the slide for engaging recesses in a conventional utility knife blade as shown in FIGS. 1 and 4. Extending longitudinally from both of the side walls 40 and 42 are a pair of spring like arm or fingers 50 and 52, each having a gripping surface 54 and 56, which may include lugs, teeth or the like for engaging and gripping a tool such as a marking crayon 58 as shown in FIG. 2. Each of the arms or fingers 50 and 52 also include a ramp cam 60 and 62 which engage the inner edges of the side walls 34 and 36 at the opening 18 of housing 12 for camming the two arms 50 and 52 and the gripping jaws 54 and 56 inward into gripping engagement with a marking crayon or other like tool. The arms 50 and 52 are preferably spring like in action such that they maintain a normally neutral position when extended beyond the outer end 18 of the housing 12 for releasing the marking crayon or the like. When the arms are pulled inward within the ends of the handle in housing 12 (FIG. 4), the fingers or arms are cammed into gripping engagement with the marking crayon for holding it.

It is thus apparent that the slide, as can be seen in FIG. 4, fits within the ends of the handle or housing 12 such that the housing acts in each instance to retain the respective tool on each end of the slide in position on the slide.

The housing face 30 includes inwardly extending ribs 64 and 66, as can be seen in FIG. 3, engaging the surface of the blade 46 for biasing it into the recess formed in the one face of the slide member and thereby releasably securely retaining the blade to the slide.

Figure 6:
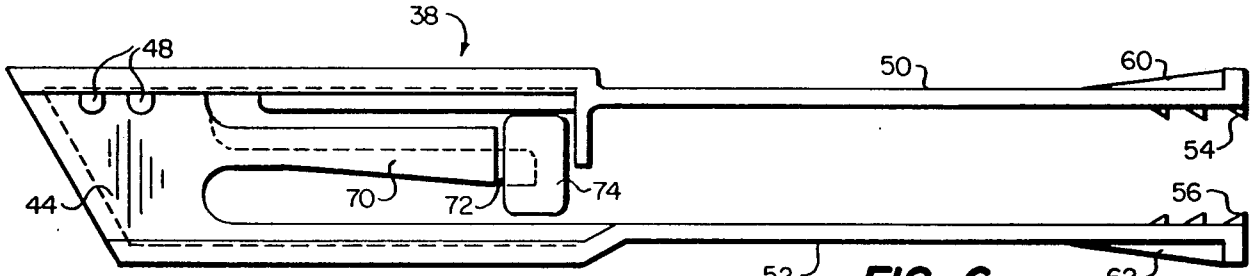
FIG. 6 is a top plan view of the slide of the embodiment of FIG. 1.
Figure 8:
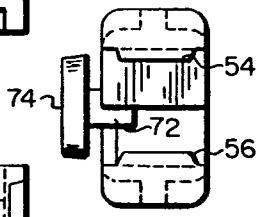
FIG. 8 is an end view of the slide of FIG. 6.
Figure 7:
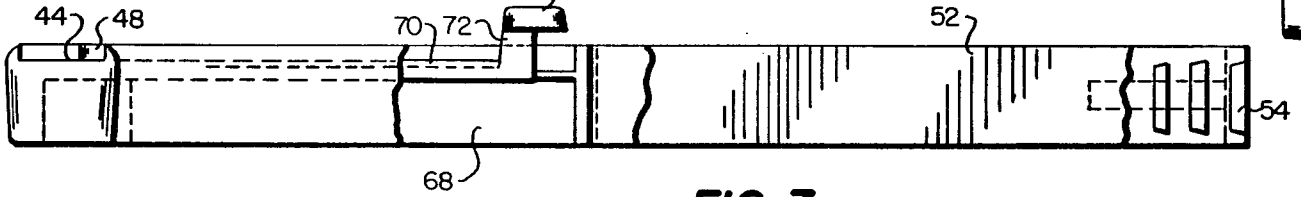
FIG. 7 is a side view of the slide of FIG. 6.

The slide also includes a storage cavity 68 as can be seen in FIGS. 3, 6 and 7, within which a plurality of blades 46 may be placed. These stowed blades are accessible upon extension of the slide outward beyond the outer end 16 of the housing.

A releasable stop arm 70 is attached at one end to the web portion 44 which connects the side walls 40 and 42 and extends longitudinally along generally the center of the slide member between the pair of arms 50 and 52 for a portion of their length, and includes an outwardly projecting finger or tab 72 having a button 74 on the outer end thereof. When the slide member is inside the housing 12, the arm or finger portion 72 normally extends through the slot 20 and is biased in two different directions. One is laterally to the engaging position with the tab 74 extending exteriorly of the housing, finger 72 being biased against the wall opposite edge 22 into the recesses 24 and 26. This forms stop means upon engagement of the finger 72 with a notch 24 or 26, or with either end 20*a* or 20*b* of slot 20. The slide stop finger 72 is biased into the respective notch until the arm is biased outward into the channel 20 so that the finger 72 clears the notch permitting the slide to move.

As stated above, the finger 72 is normally biased into engagement with the one side having the respective notches 24 and 26. The tab or button 74 is sufficiently large as to overlap the slot 20 but is of a size slightly smaller than the notch 28 at the end 20*a* of the slot 20. The notch or opening 28, at the end of slot 20, permits the removal and insertion of the slide member within the housing. The button or tab 74, when pressed downward below the surface of the front wall 30, frees the slide from slot 20 and permits the slide to be removed from the housing. The button 74 and arm 70 thus releasably holds the slide 38 in the housing. Thus, the other direction of bias of the arm 70 is upwardly against the inside surface of housing face 30.

In operation, the multiple tool assembly includes the unitary housing 12 and the unitary slide member 38 which may be constructed of a suitable plastic or the like. These two elements are assembled by inserting one end of the slide into one end of the housing such that the tab or button and arm 72 and 74 extend toward the front face 30 of the housing. The button or tab 74 is depressed to clear the wall 30 of the housing and the slide is inserted until the tab 74 passes to the slot 28 and pops up through the slot to extend beyond the surface of the housing as shown in FIG. 3. The tab 74 is then engaged by a finger and pressed to one side to clear slot 28, permitting the finger 72 to slide along the slot 20 to the next stop 26.

Prior to insertion of the slide further into the housing, a blade is inserted into the recess in the slide and as the slide is moved further along the housing, the housing overlaps, engages and retains the blade within the recess in the slide. The finger 72 slides along slot 20 until it engages slot 26, at which point it is in the position with the blade extended as shown in FIG. 1 for cutting purposes and the crayon retracted. As the tab 74 is moved laterally toward edge 22 of the slot, finger 72 is disengaged from notch 26 and the slide can be moved further until the finger engages notch 24.

At this point, the knife is retracted to a position within the housing as shown in FIG. 2 with the marker or crayon 58 extending to an operative position projecting from the housing. The tab 74 is engaged for releasing the finger from notch 24 and permitting the slide to move to the furthest end of the slot 20, thus extending the ends 54 and 56 of the arms 50 and 52 beyond the end 18 of the housing to release the crayon to enable length adjustment, removal or replacement of the marker or crayon. As the tab is moved back to the stop 24, the cams 60 and 62 bias the grips 54 and 56 and the marker is again gripped and held in position. Thus, movement of the slide between the notches 24 and 26 alternately extends and retracts the knife blade and crayon, with movement beyond these notches to the slot ends 20*a* and 20*b* enabling the removal of the respective tool, such as the knife or crayon, and replacement thereof. The entire slide can be removed from the housing, permitting access to blades in the storage chamber by pressing the tab through the slot or notch 28, permitting the slide to move beyond the end of the housing.

From the above, it is seen that I have provided an improved multiple tool assembly that is simple and inexpensive to manufacture, yet rugged and durable. In addition, I have provided a tool holder which permits the quick and easy removal and replacement of multiple tools therein. The tool assembly permits the selective extension and retraction of the respective tools relative to the housing or handle.

While I have illustrated and described my invention by means of a specific embodiment, it is to be understood that numerous changes and modifications may be made therein without departing from the spirit and scope of the invention as defined in the appended claims.

I claim:

1. A multiple use tool comprising:

an elongated handle having longitudinal throughpassage;

a first tool and a second tool;

an elongated slide having first tool holding means on one end for holding said first tool and a second tool holding means on the other end thereof for holding said second tool, said elongated slide being slideably mounted in said through-passage;

stop means comprising a closed ended slot extending along said handle and having a plurality of notches therein for receiving a latch means; and selective latch and release means comprising a spring arm on and extending along said slide means and having a finger extending outward therefrom for engaging said stop means for selectively retaining said slide in said through-passage, and for releasbly latching said slide in said housing and at selected positions along said through-passage and for enabling removal of said slide from said through-passage upon depressing said finger from said slot, said slot including notches positioned for selectively locking said first and second tools in operative positions, for selectively releasing said first and second tools, and for releasing said slide from said through-passage.

2. A tool according to claim 1 wherein said through-passage is rectangular in configuration.

3. A tool according to claim 1 wherein said through-passage is uniform in cross-section.

4. A tool according to claim 1 wherein said first tool holding means comprises a recess on one side of said slide and cooperative with one wall of said housing for retaining a tool in place when said end of said slide is within the through-passage.

5. A multiple use tool comprising:

an elongated handle having a longitudinal through-passage;

an elongated slide having first tool holding means on one end for holding a first tool and a second tool holding means on the other end thereof for holding a second tool said elongated slide being slideably mounted in said through-passage;

said second tool holding means comprises a pair of opposed axially extending fingers extending from the end of said slide;

cam means cooperatively arranged within said through-passage for biasing said fingers together for gripping said second tool therebetween;

stop means spaced along said handle; and selective release means on said slide means for engaging said stop means.

6. A tool according to claim 5 wherein said stop means comprises a slot extending along and through one wall of said handle and having a plurality of notches therein; and releasing means on said slide for engaging said slot.

7. A tool according to claim 6 wherein said releasing means comprises a spring arm extending along said slide and having a finger extending outward therefrom and biased into said notch and against one side thereof for engaging said notches.

8. A tool according to claim 1 wherein said second tool is a marking crayon.

9. A tool according to claim 1 wherein said first tool is a cutting blade, and said slide includes a storage recess for storing a plurality of said cutting blades.

10. A multiple use tool comprising:

an elongated handle having a longitudinal through-passage;

an elongated slide having first tool holding means on one end for holding a first tool and a second tool holding means on the other end thereof for holding a second tool said elongated slide being slideably mounted in said through-passage;

said first tool holding means comprises a recess on one side of said slide and cooperative with one wall of said housing for retaining a tool in place when said end of said slide is within the through-passage;

said second tool holding means comprises a pair of opposed axially extending fingers extending from the end of said slide;

cam means for biasing said fingers together for gripping said second tool therebetween;

stop means spaced along said handle; and selective release means on said slide means for engaging said stop means.

11. A tool according to claim 10 wherein:

said stop means comprises an elongated slot extending along the axis of said handle; and releasing means comprising a spring arm extending along said slide and having a finger extending outward therefrom and biased for engaging said slot.

12. A tool according to claim 11 wherein:

said first tool is a cutting blade; and said second tools is a marking crayon.

13. A tool according to claim 12 wherein:

said slide includes a recess for storing a plurality of said blades.

14. A tool assembly for multiple tools comprising:

an elongated tubular housing defining an open ended handle;

a first tool and a second tool;

slide means slideably mounted in said housing and comprising first holding means for releasably holding said first tool for selective extension from a first end of said handle and second holding means for releasably holding said second tool for selective extension from a second end of said handle; and releasable stop means between said slide and said handle, comprising a closed ended slot extending along said handle, a plurality of notches in one side of said slot, and an elongated spring member mounted on said slide means and normally biased into said slot for releasably retaining said slide in said handle, and biased into engagement with said one side of said slot for releasably engaging said notches, for releasably holding said slide in selected positions along said handle, said slot including notches positioned for selectively locking said first and second tools in operative positions, for selectively releasing said first and second tools, and for releasing said slide from said through-passage.

15. A tool assembly according to claim 14 wherein;

said first tool is a knife blade; and said first holding means comprises a recess in a side of said slide means cooperative with a wall of said handle for releasably confining said blade in said recess.

16. A tool assembly for multiple tools comprising:

an elongated tubular housing defining an open ended handle;

slide means slideably mounted in said housing and comprising first holding means for releasably holding a first tool for selective extension from a first end of said handle and second holding means for releasably holding a second tool for selective extension from a second end of said handle;

said second tool is a marking crayon;

said second holding means comprises a pair of opposed fingers extending from an end of said slide means and cam means for releasably biasing said fingers into gripping engagement with said crayon; and releasable stop means between said slide and said handle for releasably holding said slide in selected positions along said handle.

17. A tool assembly according to claim 16 wherein:

said releasable stop means comprises a slot exending along said handle, a plurality of notches in one side of said slot, and an elongated spring member mounted on said slide means and normally biased into engagement with said one side of said slot for releasably engaging said notches.

18. A tool handle for the simultaneous use with multiple tools, comprising:

an elongated tubular housing member having a through-passage of a generally rectangular cross section defining an open ended handle;

a slide member slideably mounted in said through-passage;

a cutting blade receiving recess formed in a side of said slide member and cooperative with a wall of said handle for releasably holding a blade therein;

a pair of crayon gripping fingers extending from an end of said slide member and including cam means cooperative with said handle for releasably gripping a crayon therebetween;

an elongated slot having notches therein extending along said handle; and a spring member mounted on said slide member and extending into said slot for releasably engaging said notches for releasably stopping said slide at selected positions along said slot and for releasably retaining said slide member in said handle.

19. A tool according to claim 1 wherein:

said first tool is a cutting blade; and said slide includes a storage recess adjacent said one end for storing a plurality of said cutting blades, and said recess is accessible upon extension of said one end from said through-passage.

20. A tool according to claim 14 wherein:

said first tool is a cutting blade; and said slide includes a storage recess adjacent said one end for storing a plurality of said cutting blades, and said recess is accessible upon extension of said one end from said through-passage.

* * * * *